US009025802B2

(12) United States Patent
Hau et al.

(10) Patent No.: US 9,025,802 B2
(45) Date of Patent: May 5, 2015

(54) HEARING AID WITH GUIDING MEANS FOR INSERTION

(71) Applicant: Widex A/S, Lynge (DK)

(72) Inventors: Ole Hau, Stenlose (DK); Per Kokholm Sorensen, Virum (DK); Lars Friis, Varlose (DK); Soren Christensen, Copenhagen S (DK)

(73) Assignee: Widex A/S, Lynge (DK)

( * ) Notice: Subject to any disclaimer, the term of this patent is extended or adjusted under 35 U.S.C. 154(b) by 0 days.

(21) Appl. No.: 14/069,337

(22) Filed: Oct. 31, 2013

(65) Prior Publication Data

US 2014/0050342 A1 Feb. 20, 2014

Related U.S. Application Data

(63) Continuation-in-part of application No. PCT/EP2011/056993, filed on May 3, 2011.

(51) Int. Cl.
*H04R 25/00* (2006.01)

(52) U.S. Cl.
CPC ..... *H04R 25/652* (2013.01); *H04R 25/305* (2013.01); *H04R 2460/15* (2013.01)

(58) Field of Classification Search
CPC ..... H04R 25/00; H04R 25/55; H04R 25/558; H04R 2225/49; H04R 2460/01; H04R 25/60; H04R 25/65; H04R 2225/023; H04R 2225/025
USPC ..... 381/312, 315, 318, 322, 328
See application file for complete search history.

(56) References Cited

U.S. PATENT DOCUMENTS

2007/0019817 A1 1/2007 Siltmann

FOREIGN PATENT DOCUMENTS

| | | | |
|---|---|---|---|
| WO | 2010/049543 | A2 | 5/2010 |
| WO | 2010/083888 | A1 | 7/2010 |
| WO | 2011/018086 | A1 | 2/2011 |

OTHER PUBLICATIONS

International Search Report for PCT/EP2011/056993 dated Jun. 29, 2011 with Written Opinion.

*Primary Examiner* — Suhan Ni
(74) *Attorney, Agent, or Firm* — Sughrue Mion, PLLC

(57) ABSTRACT

A hearing aid comprises a microphone for transforming an acoustic signal surrounding a hearing aid user into an electrical signal, a signal processing means for processing the electrical signal into an electrical output signal and to a receiver (2) driven by the electrical output signal and generating an acoustical signal into the ear canal (11) of a hearing aid user. The hearing aid comprises an ear plug part (1) prepared for being arranged in the ear canal of a hearing aid user. The hearing aid comprises sound generation means for generating an acoustic guiding signal to be provided for a limited period through said receiver during insertion of the ear plug part into the ear canal, in order to be applied by the hearing aid user to optimize the positioning of the ear plug part (1). The invention further provides a method for guiding a hearing aid user during insertion of an ear plug.

8 Claims, 2 Drawing Sheets

HEARING AID WITH GUIDING MEANS FOR INSERTION

RELATED APPLICATIONS

The present application is a continuation-in-part of application PCT/EP2011056993, filed on 3 May 2011, in Europe, and published as WO 2012149955 A1.

BACKGROUND OF THE INVENTION

1. Field of the Invention

The present invention relates to hearing aids. The invention further relates to a method for guiding a hearing aid user in the insertion of an ear plug.

In the context of the present disclosure, a hearing aid should be understood as a small, microelectronic device designed to be worn behind or in a human ear of a hearing-impaired user. The hearing aid is adjusted by a hearing aid fitter according to a prescription. The prescription is based on a hearing test, resulting in a so-called audiogram, of the performance of the hearing-impaired user's unaided hearing. The prescription is developed to reach a setting where the hearing aid will alleviate a hearing loss by amplifying sound at frequencies in those parts of the audible frequency range where the user suffers a hearing deficit. A hearing aid comprises one or more microphones, a microelectronic circuit comprising a signal processor, and an acoustic output transducer, in hearing aid parlance referred to as a "receiver".

A Behind-The-Ear (BTE) hearing aid is worn behind the ear, and has a housing comprising the major electronics parts behind the ear and an earpiece, sometimes called an ear plug, for emitting sound to the ear canal of the hearing aid user. The ear plug is worn in the ear, e.g. in the concha or the ear canal. In a traditional BTE hearing aid, a sound tube is used for conducting sound from a loudspeaker or receiver in the housing to the ear plug. In some types of hearing aids the receiver is arranged in the ear plug and is connected through electrical conductors to the housing behind the ear. Such hearing aids are commonly referred to as Receiver-In-The-Ear (RITE) hearing aids.

Often the receiver is placed inside the ear canal. This may be referred to as Receiver-In-Canal (RIC) hearing aids.

In-The-Ear (ITE) hearing aids are designed for arrangement in the ear, normally in the funnel-shaped outer part of the ear canal. Often the hearing aid is placed substantially inside the ear canal. This may be referred to as Completely-In-Canal (CIC) hearing aids. This type of hearing aid requires a very compact design in order to allow it to be arranged in the ear canal, while accommodating the components necessary for operation of the hearing aid, such as microphones, a microelectronic circuit comprising a signal processor, an acoustic output transducer and a battery.

Hearing aids or ear plugs of hearing aids are made to fit tightly in the ear canal of the hearing aid user in order to achieve an optimum sound amplification without risk of feedback. The receiver delivers sound into the inner part of the ear canal delimited by the ear plug or hearing aid.

Any need for air ventilation into the inner part of the ear canal is taken care of by a well controlled ventilation channel, often referred to as a vent. A ventilation channel also has the advantage of reducing any occlusion effect (see explanation in WO-A1-2010/083888 page 1-3). The ventilation channel usually has a tubular shape, and the diameter is selected as a compromise between the wish to reduce occlusion and the need to obtain a sufficiently high sound pressure level at the ear drum. The ventilation channel (or vent) is an intentional air leak between the air volume in front of the ear drum limited by the ear plug or hearing aid, and the surroundings outside the ear canal.

For hearing aid users it may be difficult to arrange the hearing aid or the hearing aid ear plug correct in the ear canal and to verify that it is correctly placed. Here the term ear plug is used to generally designate whatever part of the hearing aid is arranged in the ear canal. The ear plug may be an ear piece of a behind-the-ear hearing aid, an in-the-ear hearing aid or a completely-in-canal hearing aid. If the ear plug is not correctly placed in the ear canal an unintended air leak between the space in front of the ear drum and the surroundings may be formed. Such an air leak will increase the risk of feedback and it will reduce the sound pressure level produced by the hearing aid at lower frequencies at the ear drum. The benefits of the hearing aid will therefore be reduced.

2. The Prior Art

U.S. 2007/0019817 discloses a hearing aid which by playing an acoustic test signal can measure if the fitting of the ear plug is correct. The test signal measured by a microphone is compared to a reference determined beforehand and stored in the hearing aid. If the test signal detected by the microphone deviates from the reference, information is given to an external unit that the fitting is not correct.

WO 2010/049543 discloses a method of measuring feedback of a hearing aid and, based on a comparison with feedback measured when the ear plug is optimally fitted into the ear canal, deciding if the hearing aid is properly inserted in the ear canal of the hearing aid user.

The problem of these known means for controlling the fitting of a ear plug in the ear canal is, that they can only be applied for measuring if the fitting is correct or not. A more intuitive guidance to the hearing aid user during insertion is not provided.

SUMMARY OF THE INVENTION

The invention, in a first aspect, provides a hearing aid comprising at least one microphone for transforming an acoustic signal surrounding a hearing aid user into an electrical signal, a signal processing means for processing said electrical signal into an electrical output signal, a receiver driven by the electrical output signal and generating an acoustic signal into the ear canal of a hearing aid user, an ear plug part prepared for being arranged in the ear canal of a hearing aid user, and sound generation means for generating an acoustic guiding signal to be provided for a predetermined interval of time through said receiver during insertion of said ear plug part into the ear canal, in order to assist said hearing aid user towards optimizing the position of said ear plug part.

A hearing aid ear plug is here considered as the part of the hearing aid arranged in the ear canal, i.e. it could be the ear piece of a behind-the-ear hearing aid, an in-the-ear hearing aid or the whole of a completely-in-canal hearing aid.

The advantage of the solution is that it will provide a simple guidance which is intuitively understandable, even for new and elderly hearing aid users. The acoustic guiding signal will become louder and change its timbre (or spectral envelope) at the ear drum as the ear plug is moved into the ear canal towards the correct position and weaker as it is moved out of the ear canal away from the correct position. The acoustic guiding signal will assist in correct positioning of the ear plug as the sound heard by the hearing aid user will be shaped by the size of air leaks around the ear plug and the size of the air volume between the ear plug and the ear drum. Changes both in the volume (loudness) as well as in the timbre of the acoustic guiding signal will assist the hearing aid user in the positioning of the ear plug. Further the sound pressure level at the ear drum of the acoustic guiding signal may assist the hearing aid user in arranging the sound exit of the ear plug correctly in relation to the ear canal during insertion of the ear plug.

In an embodiment of the hearing aid the guiding sound comprises frequencies in a broad range, i.e. frequencies below 500 Hz and frequencies above 1000 Hz. Here, especially the medium frequency part in the range 1-2 kHz will assist the hearing aid user in moving the ear plug from outside the ear into the ear canal towards the correct position. The lower frequencies will subsequently assist the user in detecting if the ear plug is correctly placed inside the ear canal in relation to possible ear leaks, intentional as well as non-intentional air leaks.

In an embodiment of the hearing aid the acoustic guiding signal is provided for a predetermined period of time after the power to the hearing aid has been turned on. Then the hearing aid user does not need to do anything to turn off the signal. The time period for which the signal remains turned on may be adjustable to suit the needs of the individual user.

In a further embodiment the hearing aid comprises a wireless connection with an external device, such as a remote control, wherein a signal from said external device is adapted to initiate the acoustic guiding signal, which is convenient if the signal is desired at other times than when the hearing aid power is turned on.

In an embodiment of the hearing aid the acoustic guiding signal comprises a number of short signals with intervening pauses in the signal.

In a further embodiment of the hearing aid the ear plug is provided with a further microphone for measuring the sound pressure level in the volume between the ear plug and the ear drum, and wherein said hearing aid is adapted for detecting if the ear plug is correctly fitted by using the measuring of the sound pressure level. In this way it will be possible to provide information of changes in the effective size of the air leak, such that the hearing aid user will know if a given change is improving the fit of the hearing aid ear plug. This will guide the user to optimize the placement of the hearing aid by providing feedback on the effect of a given change.

The invention, in a second aspect, provides a method for guiding a hearing aid user during the insertion of an ear plug in order to obtain a correct position of the ear plug in the ear canal, said hearing aid having at least one microphone for transforming an acoustic signal surrounding a hearing aid user into an electrical signal, a signal processing means for processing said electrical signal into an electrical output signal, and a receiver driven by said electrical output signal and generating an acoustical signal into the ear canal of a hearing aid user, said method comprising arranging an ear plug part at the ear canal of said hearing aid user, launching an acoustic guiding signal to be generated for a predetermined interval of time through said receiver, and moving said ear plug part into the ear canal, while relying on the acoustic guiding signal to optimize the position of said ear plug part.

An embodiment of this method comprises selecting the frequency range and sound pressure level of the guiding sound or the acoustic guiding signal according to the specific hearing loss of the hearing aid user. Thereby, it will be possible for the hearing aid user to hear the guiding sound also when the ear plug is outside the ear canal, and the guiding sound can be adjusted such that the sound pressure level will not be too high when the ear plug is inserted into the ear canal.

BRIEF DESCRIPTION OF THE DRAWINGS

Some embodiments will now be explained in further detail with reference to the FIG.s.

DETAILED DESCRIPTION OF THE INVENTION

Figure 1:
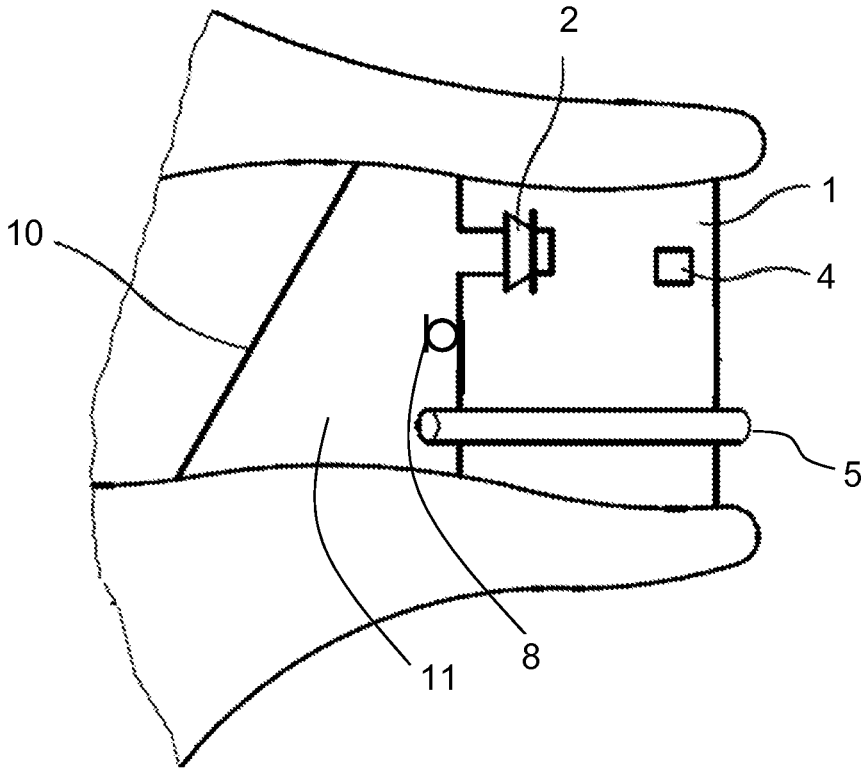
FIG. 1 illustrates an in-the-canal hearing aid.

FIG. 1 shows a completely-in-the-canal hearing aid 1 arranged in the ear canal 11 of a hearing aid user. The hearing aid 1 comprises a receiver 2 for generating an acoustic output in front of the ear drum 10, and an opening 4 for a microphone arranged in order to detect acoustic signals from outside the ear of the hearing aid user, i.e. from the surroundings. The hearing aid 1 further comprises a ventilation channel 5, i.e. an intentional air leak, e.g. for the purpose of reducing occlusion.

The hearing aid of FIG. 1 could also represent an in-the-ear hearing aid arranged partly in the canal and partly in the concha. Further, it could represent the ear plug part of a behind-the-ear hearing aid. In some behind-the-ear hearing aids the receiver is arranged in the ear plug part as illustrated in FIG. 1, in others the receiver is arranged in the behind-the-ear part and the sound guided to the ear plug part through a sound tube.

The ventilation channel 5 is an option which is often preferred due to its advantages, e.g. in relation to occlusion. However, if a high gain is necessary due to a profound hearing loss, a ventilation channel may be avoided since a higher sound pressure at the eardrum can be obtained without the ventilation channel. A ventilation channel 5 may have different forms or shapes.

A well defined acoustic guiding signal provided by the receiver 2 can be applied for guidance of the hearing aid user during insertion of the ear plug. This could be by providing a well defined sound in a broad frequency spectrum during a limited period of a time while the ear plug is inserted into the ear canal. Such a sound would become familiar to the hearing aid user who would learn to position the ear plug in the ear canal by relying on changes in the sound.

The acoustic guiding signal will be louder the closer the ear plug gets to the ear drum. I.e. the sound pressure level will be higher. Further, the frequency of the acoustic guiding signal will be shaped by the size of air leaks around the ear plug and by the size of the air volume between the ear plug and the ear drum. After a little practice with insertion of the ear plug while hearing this acoustic guiding signal the hearing aid user will learn how the volume and timbre of the acoustic guiding signal should be once the ear plug is correctly positioned in the ear canal. The acoustic guiding signal may assist the hearing aid user in arranging the sound exit of the ear plug correctly in relation to the ear canal during insertion of the ear plug. The hearing aid user will also become familiar with the gradual change during insertion of the sound of the acoustic guiding signal leading to a correct placement of the ear plug.

If desired, the ear plug can be provided with a further microphone 8 for measuring sound pressure level in the ear canal between the ear plug and the ear drum, with the hearing aid adapted for detecting if the ear plug is correctly fitted by using the measuring of the sound pressure level.

The acoustic guiding signal could be generated on an integrated circuit, e.g. the integrated circuit comprising the signal processing means. A generator of the acoustic guiding signal may be included on this circuit.

Figure 2:
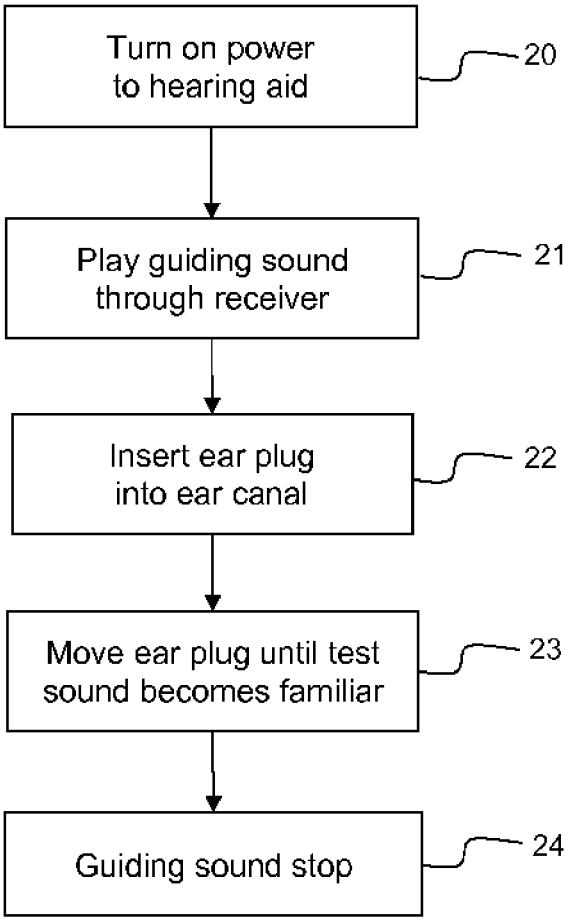
FIG. 2 illustrates a block diagram of a method for arranging an ear plug of a hearing aid in the ear canal.

FIG. 2 shows a block diagram of an embodiment of a method according to the invention. The first step 20 is to turn on the power to the hearing aid. The next step in FIG. 2 is to generate a guiding sound by the receiver. This guiding sound is applied as the acoustic guiding signal.

The hearing aid may be set up to initiate the acoustic guiding signal when the power is turned on, e.g. with a short delay of a few seconds e.g. 1-3 seconds. The duration of the acoustic guiding signal should be such that the hearing aid user has sufficient time to arrange the ear plug in the ear canal. This could be in the range 10-25 seconds, but preferably this time is adjustable during the fitting of the hearing aid. During hearing aid fitting it should also be possible to select whether the acoustic guiding signal should be applied or not.

The generated guiding sound or the acoustic guiding signal may be within a given frequency range. The acoustic guiding signal typically has a relatively broad frequency distribution covering both the 200-1000 Hz range as well as the 1-2 kHz range. Preferably, the frequency range below 500 Hz and the range above 1000 Hz are covered. The acoustic guiding signal may be provided as a continuous sound or it may be modulated e.g. to a series of short "beep" or "doing" sounds or even transient sounds like clicks.

The third step 22 in FIG. 2 is to insert the ear plug into the ear canal. The fourth step 23 is to move the ear plug until the guiding sound or the acoustic guiding signal becomes familiar. The familiar sound could be learned by the hearing aid user during fitting of the hearing aid, where the hearing aid fitter places the ear plug in the correct position and the acoustic guiding signal is played.

The fifth step 24 is that the guiding sound or acoustic guiding signal is stopped. As mentioned this may happen after a preset time, but the signal could also be stopped by the hearing aid user, e.g. by a remote controlling device.

It may also be possible to initiate the acoustic guiding signal by the hearing aid user without having to switch power to the hearing aid off and on again. This could be done by a switch on the hearing aid, or it could be done by a signal from a remote control or from another unit wirelessly connected to the hearing aid.

It should be possible to switch off the means for initiating the acoustic guiding signal when turning on power to the hearing aid. This will often be relevant once the hearing aid user has learned to arrange the ear plug correctly without the need for the acoustic guiding signal. Switching off these means may be performed by the hearing aid fitter.

We claim:

1. A hearing aid comprising at least one microphone for transforming an acoustic signal surrounding a hearing aid user into an electrical signal, a signal processor for processing said electrical signal into an electrical output signal, a receiver driven by the electrical output signal and generating an acoustic signal into the ear canal of said hearing aid user, said hearing aid further comprising:

an ear plug part configured to be arranged in the ear canal of said hearing aid user, and a guiding sound generator for generating an acoustic guiding signal to be provided for a predetermined interval of time through said receiver during insertion of said ear plug part into the ear canal, said guiding signal exhibiting a gradual change in volume and timbre during insertion of said ear plug part in order to assist said hearing aid user in the positioning of said ear plug part.

2. The hearing aid according to claim 1, wherein said guiding sound comprises frequencies in a broad range, i.e. frequencies below 500 Hz and frequencies above 1000 Hz.

3. The hearing aid according to claim 1, wherein said acoustic guiding signal is provided for a predetermined interval of time after the power to the hearing aid has been turned on.

4. The hearing aid according to claim 1, comprising a wireless connection with an external device, such as a remote control, wherein a signal from said external device is adapted to initiate said acoustic guiding signal.

5. The hearing aid according to claim 1, wherein said acoustic guiding signal comprises a number of short signals with intervening pauses in the signal.

6. The hearing aid according to claim 1, wherein said ear plug is provided with a further microphone for measuring sound pressure level in the ear canal between the ear plug and the ear drum, and wherein said hearing aid is adapted for detecting if the ear plug is correctly fitted by using the measuring of the sound pressure level.

7. A method for guiding a hearing aid user during the insertion of an ear plug in order to obtain a correct position of the ear plug in the ear canal, said hearing aid having at least one microphone for transforming an acoustic signal surrounding a hearing aid user into an electrical signal, a signal processor for processing said electrical signal into an electrical output signal, and a receiver driven by said electrical output signal and generating an acoustical signal into the ear canal of said hearing aid user, said method comprising arranging an ear plug part in the ear canal of said hearing aid user, and generating an acoustic guiding signal to be generated for a limited period of time through said receiver during insertion of said ear plug part into said ear canal, said acoustic guiding signal exhibiting a gradual change in volume and timbre during insertion of said ear plug part in order to assist the hearing aid user in the positioning of said ear plug part.

8. The method according to claim 7, comprising selecting the frequency range and sound pressure level of the acoustic guiding signal according to the specific hearing loss of the hearing aid user.

* * * * *